United States Patent [19]

Shaker et al.

[11] Patent Number: 5,044,501

[45] Date of Patent: Sep. 3, 1991

[54] DEVICE FOR STORING AND DISPENSING WASTE CONTAINERS

[76] Inventors: Holly J. Shaker, 246 Bullock St., Fall River, Mass. 02723; Norma J. Roberts, 234 Paisley Rd., Ballston Spa, N.Y. 12020

[21] Appl. No.: 404,606

[22] Filed: Sep. 8, 1989

[51] Int. Cl.[5] ..... B65D 21/00

[52] U.S. Cl. ..... 206/499; 221/307; 221/309; 312/60; 312/350

[58] Field of Search ..... 221/92, 112, 303, 307, 221/308, 309; 312/42, 60, 118, 350; 206/499; 220/22, 23.8, 20

[56] References Cited

U.S. PATENT DOCUMENTS

| | | | |
|---|---|---|---|
| 426,194 | 4/1890 | Morlan | 312/60 |
| 455,770 | 7/1891 | Smith . | |
| 1,003,669 | 9/1911 | Thayer . | |
| 1,041,192 | 10/1912 | Tarbell | 221/308 |
| 1,156,140 | 10/1915 | Hair . | |
| 1,297,205 | 3/1919 | McLaren | 221/307 |
| 1,986,101 | 1/1935 | Brodsky . | |
| 2,342,452 | 2/1944 | Casteen . | |
| 2,701,635 | 2/1955 | Mills | 220/22 |
| 2,706,066 | 4/1955 | Wells | 221/307 |
| 3,251,188 | 5/1966 | Dean et al. . | |
| 3,338,646 | 8/1967 | Harvey | 312/42 |
| 3,627,113 | 12/1971 | DiIoia | 220/339 |
| 3,845,858 | 11/1974 | Jenkins | 220/22 |
| 4,293,075 | 10/1981 | Veralrud | 312/350 |
| 4,474,294 | 10/1984 | Koppelmans et al. . | |
| 4,577,773 | 3/1986 | Bitel | 220/22 |
| 4,706,845 | 11/1987 | Schnurer et al. | 312/42 |
| 4,735,313 | 4/1988 | Schoenberg | 221/309 |
| 4,767,022 | 8/1988 | Oldorf | 221/92 |

FOREIGN PATENT DOCUMENTS

| | | | |
|---|---|---|---|
| 195170 | 9/1986 | European Pat. Off. | 221/303 |

*Primary Examiner*—David T. Fidei
*Attorney, Agent, or Firm*—Bachman & LaPointe

[57] ABSTRACT

A device for storing and dispensing waste material containers and covers therefor is formed by a columnar member having two axially spaced storage compartments. The waste containers are stored in one compartment and the covers are stored in a second compartment. Each compartment is provided with a suitable opening for dispensing the container and/or cover. The device may stand freely on a planar surface or may be fixed to a wall or other support structure.

17 Claims, 2 Drawing Sheets

DEVICE FOR STORING AND DISPENSING WASTE CONTAINERS

BACKGROUND OF THE INVENTION

The present invention relates to a device for storing and dispensing waste material containers. The device may be used either at home or at a place of business.

Many devices for storing and dispensing a variety of products are known in the art. U.S. Pat. Nos. 455,770 to Smith, 1,003,669 to Thayer, 1,156,140 to Hair, 1,986,101 to Brodsky. 2,342,452 to Casteen, 3,251,188 to Dean et al. and 4,474,294 to Koppelmans illustrate a number of these dispensing devices. Despite all these dispensing devices, there is still a need for a convenient device suitable for storing and dispensing containers for storing waste material, particularly liquid waste material.

Homeowners, in particular, are often faced with the problem of discarding liquid materials such as oils, fatty liquids, cooking grease and the like. Typically, one uses whatever container one can find. Often, a suitable container cannot be quickly or easily found. As a result, unsuitable containers such as paper boxes are used. The liquids within these containers often leak creating other disposal problems. This entire problem could be avoided if a device for storing suitable waste containers in accessible locations was available. The present invention addresses and solves this problem.

It is an object of this invention to provide a device for storing and dispensing a waste container suitable for liquid waste material and a cover therefor.

It is a further object of the present invention to provide a device as above which may be placed on a flat surface such as the top of a kitchen counter.

It is still a further object of the present invention to provide a device as above which may be mounted to a wall or a support structure.

These and other objects and advantages will become more apparent from the following description and drawings in which like reference numerals depict like elements.

SUMMARY OF THE INVENTION

The foregoing objects and advantages are achieved by the waste container storage device of the present invention. The device comprises a columnar member having two axially aligned compartments. Waste containers are stored in one compartment and covers therefor are stored in the second compartment.

Each compartment has a desired width and height and an opening through which the cover and/or container stored therein may be dispensed. A suitable opening may be located in a wall of the compartment or the front of the compartment may be left open.

The device may include a base member for allowing it to stand freely on a planar surface such as a counter top or a workbench. The device may also include means for mounting it to a vertical surface such as a wall or other support structure.

The details of the construction of the device are set out in the drawings and the following description in which like reference numerals depict like elements.

DETAILED DESCRIPTION

Figure 1:
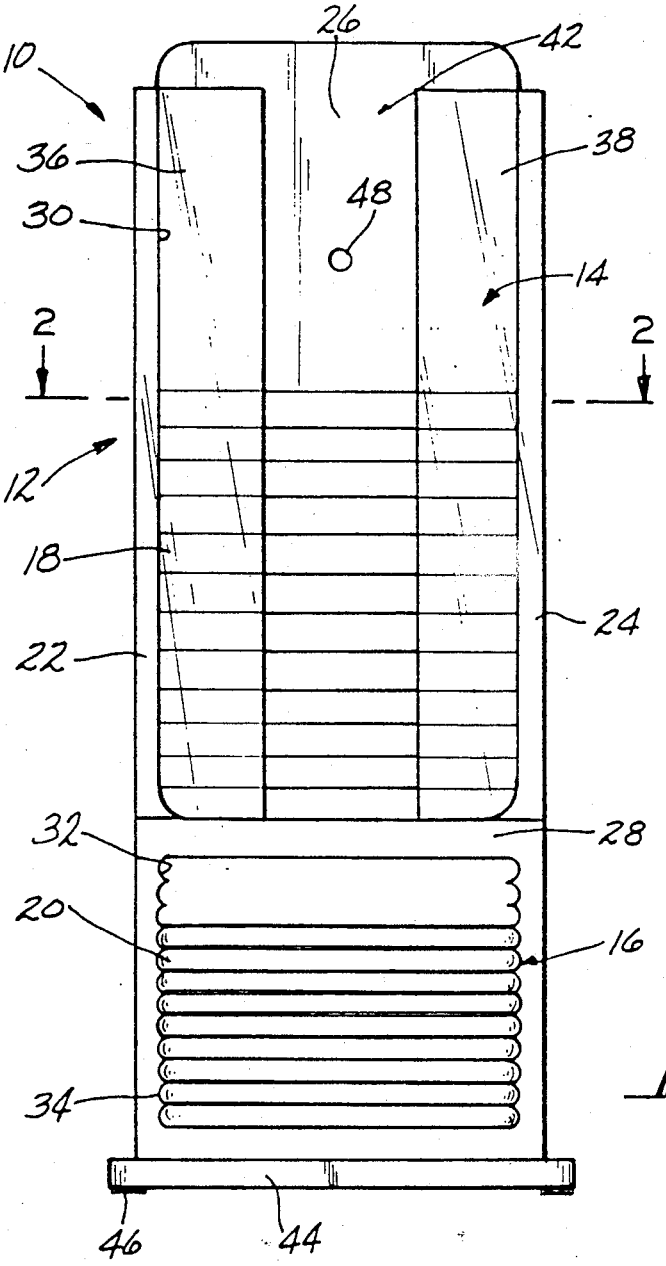
FIG. 1 illustrates a front view of a first embodiment of the device of the present invention.

Referring now to FIG. 1 of the drawings, the waste container storage and dispensing device 10 of the present invention comprises an elongated columnar member 12 having upper and lower storage compartments 14 and 16. While the device 10 may be used to store a wide variety of waste containers, a column of cylindrically shaped base portions 18 may be stored in upper compartment 14 and covers 20 for the base portion may be stored in lower compartment 16.

Figure 2:
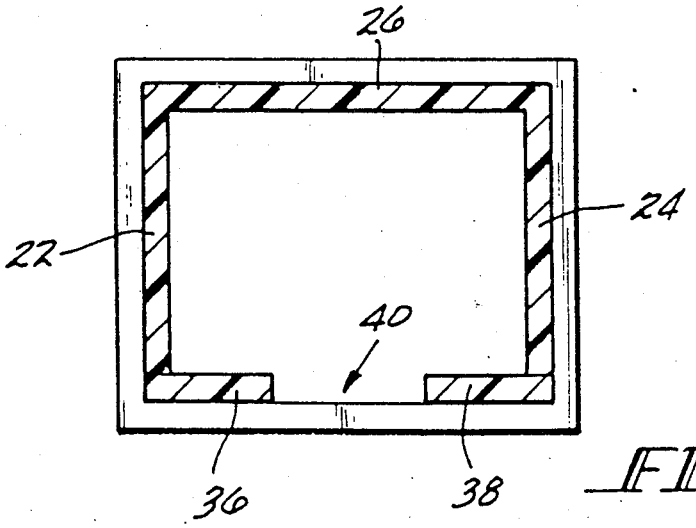
FIG. 2 is a cross sectional view taken along lines 2—2 in FIG. 1.
Figure 3:
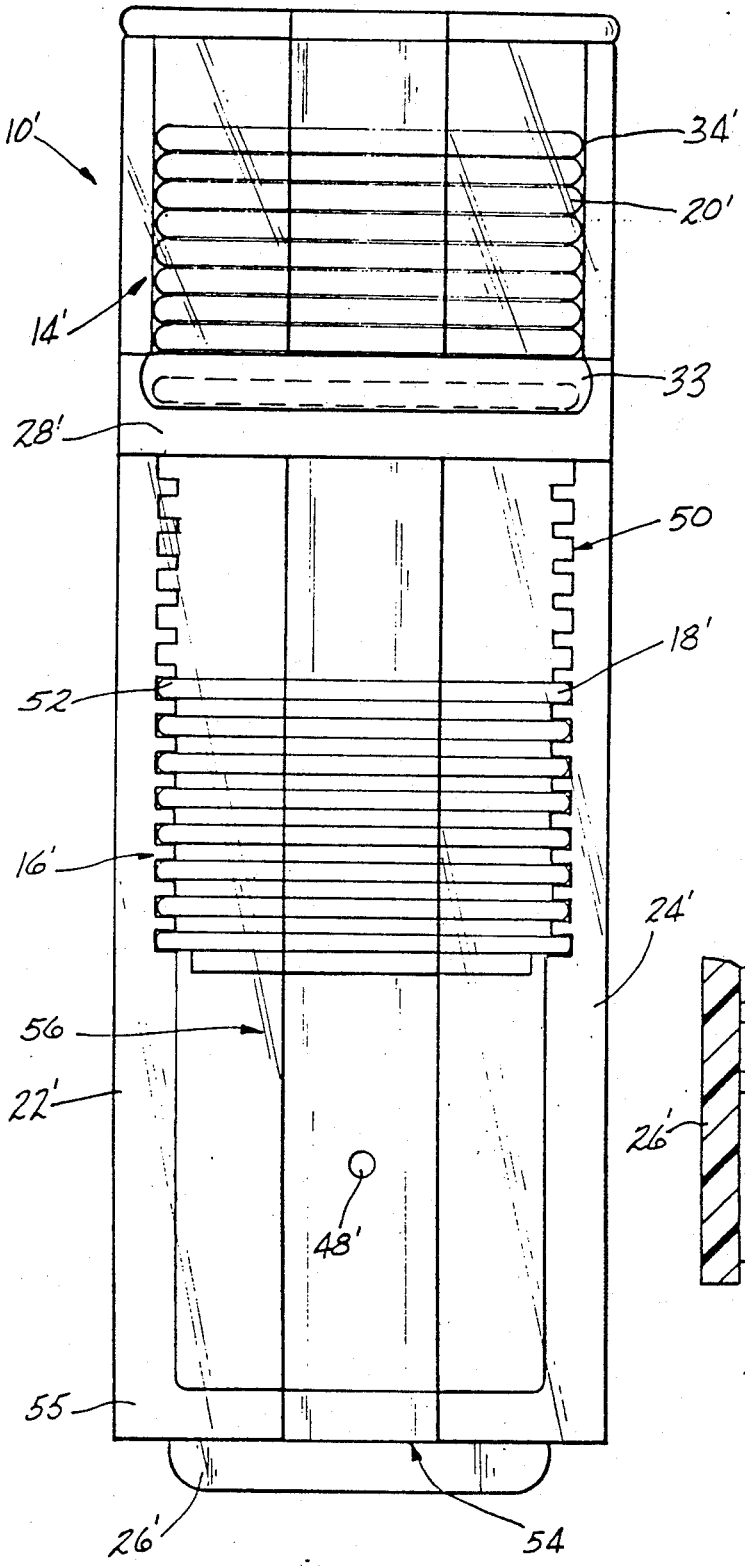
FIG. 3 is a front view of an alternative embodiment of the device of the present invention.

The member 12 may be formed from any suitable material such as wood, metal or plastic. It may also have any desired cross sectional shape or configuration. As shown in FIG. 2, typically the member 12 will have a rectangular cross sectional shape.

The member 12 is defined by a pair of sidewalls 22 and 24 and a rear wa·1 26 extending therebetween. If desired, the rear wa 1 26 may have a length greater than that of the side walls 22 and 24. The cross sectional shape of each compartment is determined by the side walls and the rear wall.

The two compartments 14 and 16 may be separated by a horizontal partition member 28. The partition member 28 may be integrally formed with the side walls 22 and 24. Alternatively, it may be a separate member which may be moved to a variety of locations. Suitable means such as grooves (not shown) in the side walls may be provided to position the partition member in a desired location. A movable partition member allows the device 10 to accommodate waste storage containers and covers having a wide variety of sizes.

The inner surface 30 of the side walls 22 and 24 may be substantially planar or may have shaped portions 32 configured to receive particular members such as the arcuate edge portions 34 of the covers 20. By providing shaped side wall portions 32, it is possible to define specific storage locations for the covers rather than merely stacking them one on top of the other.

While it is preferred to leave the front portion of lower compartment 16 open so as to facilitate removal of the covers 20, the front portion of the upper compartment 14 may be partially covered. A pair of spaced apart front wall members 36 and 38 may be fastened to respective side walls 22 and 24 in any desired manner. The wall members 36 and 38 define a slot 40 which enables a user to grab a container and push it out of the compartment 14. If desired, the front wall members may be formed from a clear material such as a clear plastic.

Instead of being separate members, the front wall members 36 and 38 may be formed by integral wall members. For example, the front wall members may be defined by bent portions of the side walls 22 and 24.

The top of the upper compartment 14 is preferably left open so that containers stored therein may be removed by manually pushing them up through the compartment and out the opening 42 in a direction parallel to the longitudinal axis of the device 10. The covers 20 are preferably removed from the lower compartment 14 by grasping a cover and sliding it outwardly in a direction substantially transverse to the device's longitudinal axis.

A base member 44 may be provided to allow the device 10 to stand on a substantially planar surface such as a countertop. The base member 44 may be formed integrally with the columnar member 12 or may be a separate member. Pads 46 for preventing skidding of the device 10 may be adhesively affixed to a lower surface of the base member. Such pads also serve to preventing marking of the surface on which the device 10 rests.

A series of holes 48 may be provided in rear wall 26 to allow the device 10 to be fastened to a wall or support structure.

Figure 4:
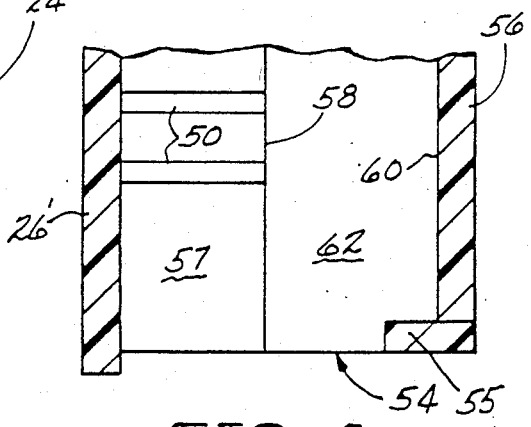
FIG. 4 is a partial cross sectional view of the lower compartment of an alternative embodiment of FIG. 3.

As shown in FIG. 4, each side wall 22 and 24 has a wall portion 57 having a surface 58 spaced from the inner surface 60 of the front face member 56. This space defines a drop zone 62 for the container. The drop zone 62 has at its lower end the opening 54 for discharging the containers. The grooves 50 for holding the containers are located within the wall portion 57. To remove a container, a user inserts one or more fingers through an opening in the face member 56 and grasps the edge of a container. The user pulls the container towards the front face until the rear edge of the container has cleared the surface 58 and has entered the drop zone 62. The user then allows the container to free fall and drop through the opening 54.

If desired, the front face member 56 may also form the face member for the upper compartment 14'. In such an arrangement, the member 56 will have a slot for enabling covers to be removed from the upper compartment.

While the device 10 may be used to store and dispense a wide variety of containers and covers, the container 18 will typically comprise a cylindrically shaped member having a diameter of about 3 inches and a height of about $4\frac{1}{2}$ inches. The containers and covers may be formed from any suitable material such as a non-porous plastic.

If desired, the side walls of the compartment 14' may be planar and may be spaced apart to define a compartment with a width slightly greater than the diameter of the covers. The covers may be stacked within the compartment so that after a bottom cover has been removed, the remaining covers drop down. If desired, a clear planar sheet material having a slot 33' for removing the covers may be placed over the front of the compartment 14'.

The side walls 22' and 24' forming the lower compartment 16' may be provided with a series of grooves 50 for accommodating a base portion 52 of the containers 18'. The grooves 50 serve to hold the containers in a desired location. When it is desired to remove one of the containers, a user may grasp it and pull it outwardly in a direction substantially transverse to the longitudinal axis of the device.

Alternatively, the lower compartment 16' may be configured so as to allow a container to be withdrawn from a groove 50 and drop through an opening 54 at the bottom of the compartment defined by the side walls 22', 24', the rear wall 26' and a lower wall portion 55. This alternative embodiment is used when a face member 56 covers the front portion of the compartment 16'. FIG. 4 illustrates this alternative configuration.

As shown in FIG. 4, each side wall 22 and 24 has a wall portion 57 having a surface 58 spaced from the inner surface 60 of the front face member 56. This space defines a drop zone 62 for the container. The drop zone 62 has at its lower end the opening 54 for discharging the containers. The grooves 50 for holding the containers are located within the wall portion 57. To remove a container, a user inserts one or more fingers through an opening in the face member 56 and grasps the edge of a container. The user pulls the container towards the front face until the rear edge of the container has cleared the surface 58 and has entered the drop zone 62. The user then allows the container to free fall and drop through the opening 54.

If desired, the front face member 56 may also form the face member for the upper compartment 14'. In such an arrangement, the member 56 will have a slot for enabling covers to be removed from the upper compartment.

While the device 10 may be used to store and dispense a wide variety of containers and covers, the container 18 will typically comprise a cylindrically shaped member having a diameter of about 3 inches and a height of about $4\frac{1}{2}$ inches. The containers and covers may be formed from any suitable material such as a non-porous plastic.

It is apparent that there has been provided in accordance with this invention a device for storing and dispensing waste containers which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A portable device for storing and dispensing containers and covers for said containers, said device comprising:

a columnar member having two spaced part side walls and a rear wall extending between said side walls;

said member having a first compartment for storing said containers and a second compartment for storing said covers;

said compartments being axially aligned and separated by a partition wall member extending between said side walls;

each said compartment having a width and a height determined by said side walls and the location of a surface of said partition wall member;

said second compartment having a plurality of shaped portions formed into a portion of said side walls defining said second compartment along two opposed inner surfaces; and said shaped portions holding said covers in a desired position.

2. A portable device for storing and dispensing containers and covers for said containers, said device comprising:

a columnar member having two spaced apart side walls and a rear wall extending between said side walls;

said member having a first compartment for storing said containers and a second compartment for storing said covers;

said compartments being axially aligned and separated by a partition wall member extending between said side walls;

each said compartment having a width and a height determined by said side walls and the location of a surface of said partition wall member;

said first compartment having a front face member formed by two vertically extending, spaced apart wall portions;

said wall portions defining a central slot; and said first compartment having an opening in a top surface through which said containers may be removed, whereby a user grasps one of said containers to be removed through said slot and manually pushes said one container through said opening in a first direction.

3. A device according to claim 2 wherein:

said covers within said second compartment are removable in a direction substantially transverse to the first direction.

4. A device in accordance with claim 2 wherein said rear wall has a greater height than said side walls.

5. A device in accordance with claim 2 which further comprises base means for allowing said device to stand freely on a substantially planar surface.

6. A device in accordance with claim 2 wherein said rear wall has at least one hole for permitting the device to be fastened to a support structure.

7. A device in accordance with claim 2 wherein said side wall, rear wall, and partition wall are formed from a plastic material.

8. A device in accordance with claim 1 wherein:

said columnar member has a longitudinal axis; and each said compartment has an opening for dispensing one of said containers and covers in a direction substantially transverse to said longitudinal axis.

9. A wall mounted device for storing and dispensing containers and covers therefor, said device comprising:

a columnar member having two spaced apart side walls and a rear wall extending therebetween and a longitudinal axis;

means for mounting said columnar member to a wall surface;

first and second compartments within said member;

first means for dispensing goods stored within a first one of said compartments, said first dispensing means comprising an opening in a bottom surface of said columnar member; and second means for dispensing goods stored within a second one of said compartments, said second dispensing means comprising a slot in a front wall of said second compartment for allowing said goods stored in said second compartment to be dispensed in a direction transverse to said longitudinal axis.

10. A device according to claim 9 wherein each compartment has side wall portions for positioning goods stored therein in defined locations.

11. A device according to claim 10 wherein:

said first compartment has a series of grooves in said side walls for positioning base portions of said containers; and said second compartment has arcuately shaped side wall portions.

12. A device according to claim 11 wherein said first dispensing means includes a drop zone through which a container removed from said grooves can drop through said opening.

13. A device according to claim 12 wherein said drop zone is partly defined by a front face member extending between said side walls.

14. A device according to claim 9 wherein said mounting means comprises at least one hole in said rear wall.

15. A device according to claim 1 wherein each said cover has a shaped edge portion configuration and said shaped portions in said side walls are substantially identical in configuration to said shaped edge portion configuration.

16. A device according to claim 1 wherein each of said plurality of shaped portions has an arcuate configuration.

17. A device in accordance with claim 2 wherein said partition wall member is formed integral with said side walls and rear wall.

* * * * *